US009074166B1

(12) United States Patent
Scheuing et al.

(10) Patent No.: US 9,074,166 B1
(45) Date of Patent: Jul. 7, 2015

(54) METHOD FOR BLEACHING A SURFACE WITH A MESITYLENE SULFONATE COMPOSITION

(71) Applicant: THE CLOROX COMPANY, Oakland, CA (US)

(72) Inventors: David R. Scheuing, Pleasanton, CA (US); Arun Agarwal, Pleasanton, CA (US); David E. Dabney, Lake Villa, IL (US); Gregory P. Dado, Chicago, IL (US); Lafayette D. Foland, Pleasanton, CA (US); Shuman Mitra, Pleasanton, CA (US); Jacqueline M. Pytel, Libertyville, IL (US); William L. Smith, Pleasanton, CA (US); Erika Szekeres, Pleasanton, CA (US); Michael R. Terry, Gurnee, IL (US); Kenneth L. Vieira, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 14/659,085

(22) Filed: Mar. 16, 2015

Related U.S. Application Data

(63) Continuation of application No. 14/079,526, filed on Nov. 13, 2013.

(51) Int. Cl.

| | |
|---|---|
| ***C11D 1/02*** | (2006.01) |
| ***C11D 3/10*** | (2006.01) |
| ***C11D 3/395*** | (2006.01) |
| ***C11D 3/34*** | (2006.01) |

(52) U.S. Cl.
CPC ..... *C11D 3/3953* (2013.01); *C11D 3/3956* (2013.01); *C11D 3/3951* (2013.01); *C11D 3/3418* (2013.01)

(58) Field of Classification Search
CPC ..... C11D 1/02; C11D 3/10; C11D 3/3418; C11D 3/395; C11D 3/3951; C11D 3/3953; C11D 3/3956
See application file for complete search history.

(56) References Cited

U.S. PATENT DOCUMENTS

| | | | |
|---|---|---|---|
| 2,495,489 | A | 1/1950 | van Andel |
| 4,001,132 | A | 1/1977 | Maguire, Jr. |
| 4,101,457 | A | 7/1978 | Place et al. |
| 4,111,651 | A | 9/1978 | Blumbergs et al. |
| 4,115,058 | A | 9/1978 | Blumbergs et al. |
| 4,123,395 | A | 10/1978 | Maguire, Jr. et al. |
| 4,169,805 | A | 10/1979 | Blumbergs et al. |
| 4,917,812 | A | 4/1990 | Cilley |
| 5,296,636 | A | 3/1994 | Siegel et al. |
| 7,144,570 | B2 | 12/2006 | Gall et al. |
| 7,495,130 | B2 | 2/2009 | Maase et al. |

FOREIGN PATENT DOCUMENTS

| | | | |
|---|---|---|---|
| CN | 102491894 | A | 6/2012 |
| GB | 1505798 | * | 3/1978 |
| GB | 1505798 | A | 3/1978 |
| WO | WO2012/133489 | A1 | 10/2012 |

OTHER PUBLICATIONS

International Search Report PCT/US13/69940; Dated Mar. 11, 2014; 4 pages.
International Search Report PCT/US13/69945; Dated Mar. 13, 2014; 4 pages.
US Office Action dated Dec. 4, 2014 for U.S. Appl. No. 14/079,477, filed Nov. 13, 2013.
US Office Action dated Dec. 4, 2014 for U.S. Appl. No. 14/079,526, filed Nov. 13, 2013.

* cited by examiner

*Primary Examiner* — Charles Boyer
(74) *Attorney, Agent, or Firm* — Alok Goel

(57) ABSTRACT

The invention relates to compositions including a hypohalite or hypochlorous acid and a soluble salt of 2,4,6 mesitylene sulfonate. The compositions may include a surfactant, a buffer, or combinations thereof. Other adjuvants may also be present. Such compositions do not require the inclusion of high concentrations of sodium hydroxide or other soluble hydroxide salts to drastically increase pH (and thus stability), although such hydroxides may be present if desired.

20 Claims, No Drawings

METHOD FOR BLEACHING A SURFACE WITH A MESITYLENE SULFONATE COMPOSITION

CROSS-REFERENCE TO RELATED APPLICATIONS

The present application is a continuation of co-pending U.S. patent application Ser. No. 14/079,477, filed on Nov. 13, 2013 and co-pending U.S. patent application Ser. No. 14/079,526, filed on Nov. 13, 2013, the disclosure of each of the above applications is incorporated by reference in its entirety.

BACKGROUND OF THE INVENTION

1. The Field of the Invention

The present invention relates to liquid compositions including hypohalite species, e.g., as used to bleach, clean, or otherwise treat a surface. In addition to such compositions, the invention relates to methods of using such compositions.

2. Description of Related Art

Sodium hypochlorite is a highly effective cleaning, bleaching and sanitizing agent that is widely used in cleaning and sanitizing various hard and soft surfaces, in laundry care, etc. Although highly effective, sodium hypochlorite is prone to degradation over time, such that a significant fraction of the hypochlorite is lost relatively quickly (e.g., over a period of days or weeks). In addition, many adjuvants whose addition would be desirable tend to quickly react with hypochlorite, further reducing stability of the formulation, while also limiting choices among otherwise desirable adjuvants.

Because of such inherent stability issues, there has been an effort to increase the stability of hypochlorite containing compositions by inclusion of various additives, such as sodium hydroxide, phosphate stabilizers, etc. While these efforts have been shown to increase the stability of the resulting liquid composition, they often also exhibit negative or undesirable side effects. For example, the addition of sodium hydroxide or other soluble, strong base hydroxides to such aqueous liquid compositions greatly increases their pH. At such very high pH values the liquid compositions can be very caustic, causing damage to surfaces into which they come in contact. In addition, inclusion of such components often does not address the issue of hypochlorite reactivity with otherwise desirable adjuvants.

As such, there continues to be a need for liquid compositions including hypohalite active species which exhibit improved stability, particularly compositions that might reduce or minimize undesirable side effects associated with alternative stabilized hypochlorite compositions, and/or broaden choices available in adjuvant selection while maintaining stability.

BRIEF SUMMARY OF THE INVENTION

An aspect of the present invention is directed to a method for treating a surface. The method comprises providing a liquid composition comprising a hypohalite or hypohalous acid and a soluble salt of 2,4,6 mesitylene sulfonate, and contacting a surface with the composition, wherein the composition treats the surface. The inclusion of the soluble salt of 2,4,6 mesitylene sulfonate has surprisingly been found to increase the stability of the hypohalite or hypohalous acid bleach component far beyond the stabilizing effect provided by other previously recognized aryl sulfonate stabilizers.

In another aspect, the present invention is directed to a method for cleaning a surface. The method comprises providing a liquid composition comprising a hypohalite or hypohalous acid and a soluble salt of 2,4,6 mesitylene sulfonate, and contacting a surface with the composition, wherein the composition cleans the surface.

In another aspect, the present invention is directed to a method for bleaching a surface. The method comprises providing a liquid bleach composition comprising a hypohalite or hypohalous acid and a soluble salt of 2,4,6 mesitylene sulfonate, and contacting a surface with the composition, wherein the composition bleaches the surface.

Further features and advantages of the present invention will become apparent to those of ordinary skill in the art in view of the detailed description of preferred embodiments below.

DETAILED DESCRIPTION OF THE PREFERRED EMBODIMENTS

I. Definitions

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising," which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more such surfactants.

As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." The term "disinfect" may generally refer to the elimination of many or all pathogenic microorganisms on surfaces with the exception of bacterial endospores. The term "sterilize" may refer to the complete elimination or destruction of all forms of microbial life and which is authorized under the applicable regulatory laws to make legal claims as a "sterilant" or to have sterilizing properties or qualities.

As used herein, the term "substrate" is intended to include any material that is used to clean an article or a surface. Examples of cleaning substrates include, but are not limited to nonwovens, sponges, films and similar materials which in some embodiments can be attached to a cleaning implement, such as a floor mop, handle, or a hand held cleaning tool, such as a toilet cleaning device. In an embodiment, the substrate may be a wipe.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage are in weight percent (based on 100 weight percent active) of the particular material present in the referenced composition, any remaining percentage being water or an aqueous carrier sufficient to account for 100% of the composition, unless otherwise noted. For very low weight percentages, the term "ppm" corresponding to parts per million on a weight/weight basis may be used, noting that 1.0% by weight corresponds to 10,000 ppm.

II. Introduction

The present inventors have surprisingly found that the inclusion of a soluble salt of 2,4,6 mesitylene sulfonate in a liquid composition comprising at least one of a hypohalite or hypohalous acid bleach component increases the stability of compositions comprising the hypohalite or hypohalous acid bleach component. This increase in stability resulting from the inclusion of a soluble salt of 2,4,6 mesitylene sulfonate is surprisingly far beyond the stabilizing effect provided by other, previously employed, aryl sulfonate stabilizers.

Hypohalite or hypohalous acid bleach components are typically less stable at lower pH values than at higher pH values. As such, typical practice has been to increase composition pH to 12 or higher, e.g., by adding significant quantities of sodium hydroxide or other strong hydroxide bases to the compositions. While these compositions advantageously exhibit increased stability due to the higher pH, they also exhibit negative characteristics due to the caustic high pH, so as to damage certain household surfaces, the surfaces of instruments and devices used in health care facilities, not to mention the damage caused upon contact with tissues of users or other living organisms. As a result, it would be highly desirable if a method of stabilizing the hypohalite or hypohalous acid bleach components could be provided, without raising the pH of the compositions to such a considerable degree. It would be a further advantage if such stabilization could also temper reactivity between the hypochlorite and various adjuvants which are typically not included in hypochlorite containing liquid compositions due to reactivity of the adjuvant with the hypochlorite.

While various aryl sulfonates may have been identified as capable of providing a stabilizing benefit to hypohalite bleach compositions, no one has yet recognized the unusually superior stabilizing effect provided by soluble salts of 2,4,6 mesitylene sulfonate in such hypohalite or hypohalous acid liquid compositions. The stabilizing characteristics of the described soluble salts of 2,4,6 mesitylene sulfonate are far beyond the stabilizing effect of previously studied aryl sulfonates, such as sodium xylene sulfonate. In other words, while aryl sulfonates may have been identified as a class of materials capable as acting as hypohalite stabilizers, soluble salts of 2,4,6 mesitylene sulfonate have been found by the present inventors to be surprisingly and unexpectedly superior to other aryl sulfonates that have been used to stabilize hypohalite and hypohalous acid bleach components within liquid compositions.

III. Exemplary Liquid Compositions

The benefits of using hypohalite or hypohalous acid containing compositions include but are not limited to cleaning, disinfection, sterilization, stain removal, deodorization, mold removal, toxin and/or allergen remediation, and/or laundry textile cleaning, bleaching and whitening. The compositions may include, but are not limited to antimicrobial compositions suitable for contact with food, antimicrobial compositions for treating hard surfaces, antimicrobial compositions for treating articles or other surfaces, all-purpose cleaners, dish cleaning compositions, drain cleaning or clearing compositions, glass cleaners, hard surface cleaners, soft surface cleaners, toilet cleaning compositions (e.g., automatic toilet bowl cleaners and manual toilet bowl cleaners), laundry detergents, and laundry additives. The compositions may be provided in various forms, including but not limited to, aerosol form, concentrate form, in a pouch, as a ready-to-use foam, ready-to-use gel, ready-to-use spray, or a wipe or other substrate including the composition.

The invention is also directed to methods of use. In one embodiment, a method for treating a surface comprises: providing a liquid composition and contacting a surface with the composition, such that the composition treats the surface. In another embodiment, a method for cleaning a surface comprises: providing a liquid composition and contacting a surface with the composition, such that the composition cleans the surface. In another embodiment, a method for bleaching a surface comprises: providing a liquid composition and contacting a surface with the composition, such that the composition bleaches the surface.

a. Soluble Salts of 2,4,6 Mesitylene Sulfonate

Soluble salts of 2,4,6 mesitylene sulfonate have the chemical formula $C_9H_{11}SO_3^-M^+$, wherein $M^+$ is a soluble metal ion such as sodium. Soluble salts of 2,4,6 mesitylene sulfonate have the following structure:

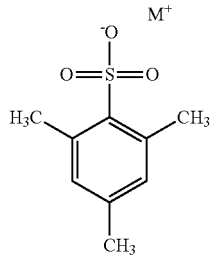

The structure of 2,4,6 mesitylene sulfonate is characterized by a symmetrical substitution pattern about the aromatic ring. The addition of a sulfonate group to 1,3,5 trimethyl benzene (also known as mesitylene) in order to form 2,4,6 mesitylene sulfonate, and the formation of soluble salts of 2,4,6 mesitylene sulfonate, can be accomplished by any suitable means.

In an embodiment, the soluble salt of 2,4,6 mesitylene sulfonate may be an alkali metal salt (e.g., sodium, potassium, lithium, etc.), an alkaline earth metal salt (e.g., calcium, magnesium, etc.), other soluble salts of 2,4,6, mesitylene sulfonate, or combinations thereof. One particularly preferred example includes sodium 2,4,6 mesitylene sulfonate (2,4,6 SMS). Other alkali metal salts of 2,4,6 mesitylene sulfonate may also be suitable for use, such as potassium 2,4,6 mesitylene sulfonate, lithium 2,4,6 mesitylene sulfonate, or combinations thereof.

In an embodiment, the composition may include from about 0.01% to about 20% by weight of the soluble salt of 2,4,6 mesitylene sulfonate, from about 0.05% by weight to about 10% by weight of the composition, from about 0.1% to about 8% by weight of the composition, or from about 0.1% by weight to about 5% by weight of the composition.

As will be shown hereafter in the Examples, surprisingly, the addition of other isomers of mesitylene sulfonate, such as 2,3,5 SMS or 2,4,5 SMS does not provide anywhere near the same level of bleach retention exhibited upon addition of the specific isomer 2,4,6 SMS to liquid hypochlorite containing compositions. Applicants speculate, without being bound by any particular theory, that the specific interactions of 2,4,6 SMS with surfactant micelles result in a strong increase in the repulsion of hypochlorite from the micelle surfaces, thus reducing the reaction rate of the hypochlorite with a very wide range of surfactant types, as will be described by the Examples below.

While aromatic sulfonates (a.k.a. aryl sulfonates) generally, and specifically species of aromatic sulfonates other than 2,4,6 SMS have been described within the art as providing a stabilizing effect on hypochlorite solutions, 2,4,6 SMS has been found to be far superior to the previously disclosed specific stabilizing species of aromatic sulfonates. Applicants speculate, without being bound to any particular theory, that the net benefit to the stability of hypochlorite through the addition of 2,4,6 SMS to formulations including hypochlorite is due to a combination of the inherent stability of 2,4,6 SMS itself to reaction with hypochlorite, and to the interactions of 2,4,6 SMS with surfactant micelles. Such interactions may be characterized as chaotropic behavior, apparently resulting in an association of the 2,4,6 SMS with micelles that results in modulation of the net charge on the micelles.

In aqueous solution, chaotropic ions, such as 2,4,6 SMS are characterized by their ability to associate with interfaces such as the air-water interface, solid-water interface, or the surfaces of micelles or lipid bilayers. A combination of several forces, including so called hydrophobic and dispersion forces are thought to be responsible for the association of chaotropic ions with these interfaces. The combination of these forces can result in the association of, for example, a negatively charged chaotropic ion with a negatively charged surface. In other words, the electrostatic repulsion between negatively charged structures may be overcome by the combination of other forces. Chaotropic ions, such as 2,4,6 SMS are not surfactants in the typical sense. They do not exhibit sudden changes in self-aggregation as a function of concentration, i.e., they do not exhibit critical micelle concentrations in aqueous solution.

Applicants speculate that the association of 2,4,6 SMS with micelles of all types results in a more negative charge near the micelle surface, which in turn results in kinetic repulsion of hypochlorite anions from the micelles, which in turn results in significant reductions in the rate of reaction of hypochlorite with the surfactant molecules comprising the micelles. Surprisingly and unexpectedly, the chaotropic behavior of 2,4,6 SMS, coupled with its inherent stability as regarding reaction with hypochlorite, results in a mechanism by which hypochlorite stability may be controlled and improved over other systems comprising surfactants and aromatic sulfonates previously known to the art.

b. Hypohalites and Hypohalous Acid Bleach Components

The compositions advantageously include a hypohalite, a hypohalous acid, or combinations thereof. Hypohalites and hypohalous acids are powerful oxidants with a wide range of uses, including antimicrobial action and bleaching of stains from soils, inks, foods, and other sources that are common on household and other environmental surfaces. Such compositions can be used on a wide range of surfaces, including hard and soft surfaces (e.g., laundry).

Hypohalites refer to salts of hypohalous acids. Hypochlorites and hypochlorous acid may be particularly preferred, although other hypohalites and hypohalous acids (e.g., hypobromites, hypobromous acid, etc.) may also be suitable for use. The salts may be alkali metal or alkaline earth metal salts of a hypohalous acid (e.g., hypochlorous acid), including combinations of salts, or combinations of a salt and an acid. Specific examples of hypohalites include sodium hypochlorite, potassium hypochlorite, calcium hypochlorite, magnesium hypochlorite, lithium hypochlorite, and combinations thereof. Analogous hypobromites and other hypohalites may also be suitable for use.

In an embodiment, the hypohalite and/or hypohalous acid components may be present in an amount from above 0% to about 10% by weight of the composition, from about 0.01% to about 10% by weight of the composition, from about 0.05% to about 8% by weight of the composition, from about 0.1% to about 5% by weight of the composition, or from about 1% to about 5% by weight of the composition.

c. Buffers

Suitable buffers include those materials capable of controlling ultimate solution pH and which themselves resist reaction with the oxidant and remain in sufficient concentration to control the pH. Suitable buffers further include those buffers that are non-consumable with respect to action by the oxidant. In addition, suitable buffers may have an acid dissociation constant (Ka) at 20° C. in the range from about $1\times10^{-2}$ to about $1\times10^{-12}$, from about $1\times10^{-3}$ to about $1\times10^{-11}$, from about $1\times10^{-3}$ to about $1\times10^{-8}$, or from about $1\times10^{-8}$ to about $1\times10^{-12}$.

Suitable buffers may include salts and/or corresponding conjugate acids and bases of the following classes of materials, and their derivatives: carbonates, bicarbonates, silicates, boric acid and borates, di- and mono-basic phosphates or phosphoric acid, monocarboxylic or polycarboxylic acids such as acetic acid, succinic acid, octanoic acid, the like, and combinations thereof. Sodium carbonate is one such specific example.

In an embodiment, the buffer, if present, may be present from about 0.01% by weight to about 10% by weight, from about 0.05% to about 8% by weight, from about 0.1% by weight to about 5% by weight, or from about 1% by weight to about 5% by weight.

d. Surfactants

Surfactants may be added to improve the wetting or spreading ability of the formulation on surfaces through a reduction in surface tension. In addition, surfactants can aid in solubilizing oily soils, driving the detergency process. Surfactants may also be employed to aid in solubilizing aesthetic components such as fragrances, which can profoundly affect consumer preference between formulations with similar detergency performance. A very wide range of surfactants and mixtures of surfactants may be used, including anionic, nonionic, cationic, amphoteric, zwitterionic surfactants and mixtures thereof. Mixtures of different classes of surfactants may be employed.

Examples of cationic surfactants include, but are not limited to monomeric quaternary ammonium compounds. Suitable exemplary quaternary ammonium compounds are available from Stepan Co. under the tradename BTC®) (e.g., BTC® 1010, BTC® 1210, BTC® 818, BTC® 8358). Any other suitable monomeric quaternary ammonium compound may also be employed. BTC® 1010 and BTC® 1210 are described as didecyl dimethyl ammonium chloride and a mixture didecyl dimethyl ammonium chloride and n-alkyl dimethyl benzyl ammonium chloride, respectively. Cetyl (C16) trimethylammonium chloride (AMMONYX® CETAC) and pentyl (C5) trimethyl ammonium chloride are specific examples of cationic quaternary ammonium surfactants.

Additional exemplary cationic surfactants include alkyltrimethylammonium, alkylpryidinium, and alkylethylmorpholinium salts, in which the alkyl group contains 4 to 18 carbon atoms, alternatively 12 to 16 carbon atoms. The alkyl chains may be linear or branched or contain an aryl group. The counterion may be, but is not limited to, chloride, sulfate, methylsulfate, ethylsulfate, or toluene sulfonate. Other suitable cationic surfactants include dialkyldimethyl ammonium salts, in which the alkyl groups each contain 4 to 12 carbon atoms such as dioctyldimethyl ammonium chloride. Other suitable cationic surfactants may have two quaternary ammonium groups connected by a short alkyl chain such as N-alkylpentamethyl propane diammonium chloride. In the above cationic surfactants the methyl substituents can be completely or partially replaced by other alkyl or aryl substituents such as ethyl, propyl, butyl, benzyl, and ethylbenzyl groups, for example octyldimethylbenzyl ammonium chloride and tetrabutylammonium chloride.

Examples of anionic surfactants include, but are not limited to alkyl sulfates (e.g., C8-C18 linear or branched alkyl sulfates such as sodium lauryl sulfate (SLS), and sodium tetradecylsulfate), alkyl sulfonates (e.g., C6-C18 linear or branched alkyl sulfonates such as sodium octane sulfonate and sodium secondary alkane sulfonate, alkyl ethoxysulfates, fatty acids and fatty acid salts (e.g., C6-C16 fatty acid soaps such as sodium laurate), and alkyl amino acid derivatives. Other examples may include sulfate derivatives of alkyl ethoxylate propoxylates, alkyl ethoxylate sulfates, alpha olefin sulfonates, C6-C16 acyl isethionates (e.g. sodium cocoyl isethionate), C6-C18 alkyl, aryl, or alkylaryl ether sulfates, C6-C18 alkyl, aryl, or alkylaryl ether methyl-sulfonates, C6-C18 alkyl, aryl, or alkylaryl ether carboxylates, sulfonated alkyldiphenyloxides (e.g. sodium dodecyldiphenyloxide disulfonate), and combinations thereof. Sodium lauryl sulfate (SLS) is an example of a suitable alkyl sulfate surfactant. Steol® CS-230 (Stepan Co.) is an example of an alkyl ethoxysulfate. BIO-SOFT® S-101 (Stepan Co.) is an example of an alkylbenzene sulfonate surfactant.

Other nitrogen containing surfactants may also be employed. They may be amphoteric or zwitterionic. These include amine oxides, sarcosinates, taurates and betaines. Examples include C8-C18 alkyldimethyl amine oxides (e.g., octyldimethylamine oxide, lauryldimethylamine oxide, and cetyldimethylamine oxide), C4-C16 dialkylmethylamine oxides (e.g. didecylmethylamine oxide), C8-C18 alkyl morpholine oxide (e.g. laurylmorpholine oxide), tetra-alkyl diamine dioxides (e.g. tetramethyl hexanane diamine dioxide, lauryl trimethyl propane diamine dioxide), C8-C18 alkyl betaines (e.g. decylbetaine and cetylbetaine), C8-C18 acyl sarcosinates (e.g. sodium lauroylsarcosinate), C8-C18 acyl C1-C6 alkyl taurates (e.g. sodium cocoylmethyltaurate), C8-C18 alkyliminodipropionates (e.g. sodium lauryliminodipropionate), and combinations thereof. Lauryl dimethyl amine oxide (AMMONYX® LO) and myristyl dimethyl amine oxide (AMMONYX® MO) are examples of suitable amphoteric surfactants, available from Stepan Co.

Examples of nonionic surfactants include, but are not limited to, mono or alkyl amine oxides, alkyl phosphine oxides, alkyl glucosides and alkyl pentosides, alkyl glycerol esters, alkyl ethoxylates, and alkyl and alkyl phenol ethoxylates of all types, poly alkoxylated (e.g. ethoxylated or propoxylated) C6-C12 linear or branched alkyl phenols, C6-C22 linear or branched aliphatic primary or secondary alcohols, and C2-C8 linear or branched aliphatic glycols. Block or random copolymers of C2-C6 linear or branched alkylene oxides may also be suitable nonionic surfactants. Capped nonionic surfactants in which the terminal hydroxyl group is replaced by halide; C1-C8 linear, branched or cyclic aliphatic ether; C1-C8 linear, branched or cyclic aliphatic ester; phenyl, benzyl or C1-C4 alkyl aryl ether; or phenyl, benzyl or C1-C4 alkyl aryl ester may also be used. Sorbitan esters and ethoxylated sorbitan esters may also be useful nonionic surfactants. Other suitable nonionic surfactants may include mono or polyalkoxylated amides of the formula $R^1CONR^2R^3$ and amines of the formula $R^1NR^2R^3$ wherein $R^1$ is a C5-C31 linear or branched alkyl group and $R^2$ and $R^3$ are C1-C4 alkyl, C1-C4 hydroxyalkyl, or alkoxylated with 1-3 moles of linear or branched alkylene oxides. BIO-SOFT® N91-6 (Stepan Co.) is an example of an alkyl ethoxylate (or alcohol ethoxylate) having a methylene chain length of C9 to C11 with an average of 6 moles of ethoxylation.

Alkylpolysaccharides that may be suitable for use herein are disclosed in U.S. Pat. No. 4,565,647 to Llenado, having a linear or branched alkyl, alkylphenyl, hydroxyalkyl, or hydroxyalkylphenyl group containing from 6 to 30 carbon atoms and a polysaccharide, e.g., a polyglycoside, hydrophilic group containing from 1.3 to 10 saccharide units. Suitable saccharides include, but are not limited to, glucosides, galactosides, lactosides, and fructosides. Alkylpolyglycosides may have the formula: $R^2O(CnH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 10.

Fatty acid saccharide esters and alkoxylated fatty acid saccharide esters may also be suitable for use in the present invention. Examples include, but are not limited to, sucrose esters, such as sucrose cocoate, and sorbitan esters, such as polyoxyethylene(20) sorbitan monooleate and polyoxyethylene(20) sorbitan monolaurate.

A wide variety of phosphate ester surfactants may also be suitable. These include mono, di, and tri esters of phosphoric acid with C4-C18 alkyl, aryl, alkylaryl, alkyl ether, aryl ether and alkylaryl ether alcohols (e.g. disodium octyl phosphate).

In one embodiment, the surfactants may be selected based on green or natural criteria. For example, there is an increasing desire to employ components that are naturally-derived, naturally-processed, and biodegradable, rather than simply being recognized as safe. Such "natural surfactants" may be produced using processes perceived to be more natural or ecological, such as distillation, condensation, extraction, steam distillation, pressure cooking and hydrolysis.

A typical listing of anionic, amphoteric, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Additional details of various surfactants that may be suitable for use are found in U.S. Publication 2013/0028990. The above patents and applications are each herein incorporated by reference in their entirety.

e. Other Adjuvants

A wide range of optional adjuvants may be present. For example, oils, fragrances, solvents, pH adjusters (e.g., acids or bases), builders, silicates, preservatives and chelating agents, including but not limited to EDTA salts, GLDA, gluconates, 2-hydroxyacids and derivatives, glutamic acid and derivatives, trimethylglycine, etc. may be included.

Dyes and colorants may be present. Thickeners may be present.

Enzymes may be present, particularly when the formulations are tuned for use as laundry detergents or as cleaners for kitchen and restaurant surfaces, or as drain openers or drain maintenance products.

Water-miscible solvents may be present in some embodiments. Lower alcohols (e.g., ethanol), ethylene glycol, propylene glycol, glycol ethers, and mixtures thereof with water miscibility at 25° C. may be present in some embodiments. Other embodiments will include no lower alcohol or glycol ether solvents. Where such solvents are present, some embodiments may include them in only small amounts, for example, of not more than 5% by weight, not more than 3% by weight, or not more than 2% by weight.

Water-immiscible oils or solvents may be present, being solubilized into the surfactant micelles. Among these oils include those added as fragrances. Preferred oils are those that are from naturally derived sources, including the wide variety of so-called essential oils derived from a variety of botanical sources. Formulations intended to provide antimicrobial benefits, coupled with improved overall sustainability may advantageously comprise quaternary ammonium compounds in combination with essential oils such as thymol and the like, preferably in the absence of water-miscible alcohols.

Silicates, builders, chelating agents, preservatives, fragrances, and any other adjuvants may be included in appropriate, effective amounts. In some embodiments, such levels may be from 0.1 to 10% by weight, or from about 0.1 to 5% by weight, or from about 0.1 to 1% by weight.

Concentrated forms of the formulations may be developed which may be diluted by the consumer to provide solutions that are then used. Concentrated forms that suitable for dilution via automated systems, in which the concentrate is diluted with water, or in which two solutions are combined in a given ratio to provide the final use formulation are possible.

The compositions are liquids (e.g., as opposed to solid compositions). In an embodiment, the composition may be substantially free of other aryl sulfonates included as stabilizers, such as sodium xylene sulfonate, para-toluene sulfonic acid (PTSA), naphthalene sulfonate, benzene sulfonate, and chloro benzene sulfonate. The composition may be substantially free of isomers of the included 2,4,6 mesitylene sulfonate salt. For example, the composition may be substantially free of sodium 2,4,5 mesitylene sulfonate, 2,3,5 mesitylene sulfonate or combinations thereof. In compositions which are substantially free of sodium 2,4,5 mesitylene sulfonate, 2,3,5 mesitylene sulfonate or combinations thereof, these isomers may be present at a concentration which is 10% of the concentration of the 2,4,6 mesitylene sulfonate salt which is present.

IV. Examples

The stability of hypochlorite in formulations comprising surfactants, 2,4,6 SMS and other additives was monitored via standard titrations of the hypochlorite after aging of the formulations. Various formulations were prepared and then stored in glass test tubes which were sealed with Teflon-lined caps. The tubes were placed in a water bath set to 49° C. in order to provide reproducible temperature histories of the formulations to be compared. The source of the hypochlorite was commercially available Clorox® Germicidal Bleach. The hypochlorite level of the bleach source was determined immediately before preparation of the various formulations.

It is highly desirable for cleaning formulations comprising hypochlorite to exhibit stability such that about 50% or more of the initial hypochlorite concentration is retained after aging 28 days at 49° C. While 50% or better retention is one benchmark, any significant improvement, whether lower or higher than 50% retention, can be highly advantageous. For example, where only 0% to about 10% of the hypochlorite is retained after 28 days in a control scenario (or a scenario based on existing art), an increase in hypochlorite retention to values of even 25%, 30%, or 40% is a significant benefit. Of course, increases to about 50% or better retention represent an even further improvement.

Example 1

Bleach Retention of Formulations Comprising Anionic Surfactant Micelles and Additives Table 1 shows compositional and bleach stability data for Formulations 1-1 through 1-6. Formulation 1-1 included no stability additive (e.g., the control). Formulation 1-2 included 1.36% sodium xylene sulfonate (SXS). Formulation 1-3 included 1.5% sodium para-toluene sulfonate (Na-PTSA). Formulation 1-4 included 4% sodium nitrate. Formulation 1-5 included 1% 2,3,5 sodium mesitylene sulfonate (2,3,5, SMS). Formulation 1-6 included 1% 2,4,6 sodium mesitylene sulfonate (2,4,6 SMS). Each formulation included 1% Stepanol® WA-Extra HP, a sodium lauryl sulfate surfactant, 1% sodium hypochlorite (Clorox® Germicidal Bleach sodium hypochlorite solution), and 2.5% of an anhydrous reagent grade sodium carbonate buffer.

TABLE 1

| Formulation | Components | Wt % Actives | Bleach retention at 28 days, % |
|---|---|---|---|
| 1-1 (no additive) | Stepanol ® WA-Extra HP (SLS) | 1 | 11 |
| | $Na_2CO_3$ | 2.5 | |
| | NaOCl | 1 | |
| | DI-water | Balance | |
| 1-2 (SXS additive) | Stepanol ® WA-Extra HP (SLS) | 1 | 36 |
| | $Na_2CO_3$ | 2.5 | |
| | NaOCl | 1 | |
| | Sodium Xylene Sulfonate | 1.36 | |
| | DI-water | Balance | |
| 1-3 (Na-PTSA additive) | Stepanol ® WA-Extra HP (SLS) | 1 | 33 |
| | $Na_2CO_3$ | 2.5 | |
| | NaOCl | 1 | |
| | Sodium Para-toulene Sulfonate | 1.5 | |
| | DI-water | Balance | |
| 1-4 ($NaNO_3$ additive) | Stepanol ® WA-Extra HP (SLS) | 1 | 21 |
| | $Na_2CO_3$ | 2.5 | |
| | NaOCl | 1% | |
| | $NaNO_3$ | 4% | |
| | DI-water | Balance | |
| 1-5 (2,3,5 SMS additive) | Stepanol ® WA-Extra HP (SLS) | 1 | 34 |
| | $Na_2CO_3$ | 2.5 | |
| | NaOCl | 1% | |
| | 2,3,5 SMS | 1% | |
| | DI-water | Balance | |

TABLE 1-continued

| Formulation | Components | Wt % Actives | Bleach retention at 28 days, % |
|---|---|---|---|
| 1-6 (2,4,6 SMS additive) | Stepanol ® WA-Extra HP (SLS) | 1 | 72 |
| | $Na_2CO_3$ | 2.5 | |
| | NaOCl | 1% | |
| | 2,4,6 SMS | 1% | |
| | DI-water | Balance | |

Table 1 shows the stability of hypochlorite in various formulations comprising an anionic surfactant, sodium lauryl sulfate. The "bleach retention" is expressed as the percent of the initial hypochlorite concentration remaining after 28 days at 49° C. All of the formulations of Example 1 comprised 1% sodium hypochlorite initially. Thus, formulation 1, which is the control formulation, showed retention of only 11% of the initial sodium hypochlorite after 28 days.

The results of formulations 1-2 and 1-3 in Table 1 show that the addition of sodium xylene sulfonate ("SXS") or sodium para-toluene sulfonate ("Na-PTSA"), both aryl sulfonates, can provide a boost in the bleach retention of formulations comprising an anionic surfactant relative to the control formulation (formulation 1-1). The use of these specific aromatic sulfonates in formulations with hypochlorite is known in the art. However, the bleach retention is still relatively low after 28 days at 49° C. (36% and about 33%, respectively).

The results of formulation 1-5 in Table 1 show that the addition of 2,3,5 SMS can also provide a boost in the bleach retention (34%), similar to the boost provided by the aryl sulfonates of formulations 1-2 and 1-3. Surprisingly, however, the addition of 2,4,6 SMS can provide a significantly greater boost to bleach retention as compared to the other aryl sulfonates. For example, formulation 1-6 surprisingly shows a bleach retention of 72%, about double that provided by any other tested aryl sulfonate. Applicants speculate, without being bound by theory, that the chaotropic interactions of 2,4,6 SMS with micelles comprising an anionic surfactant provide an increase in the total number of anionic charges near the surface of the surfactant micelles, resulting in an increase in the repulsion of hypochlorite anions from the micelles, and hence a reduction in the reaction of hypochlorite with the surfactant molecules comprising the micelles.

Example 2

Bleach Retention of Formulations Comprising Cationic Surfactant Micelles and Additives Table 2 shows compositional and bleach stability data for Formulations 2-1 through 2-8. Formulations 2-1 through 2-6 included AMMONYX® CETAC, a cetyl (C16) trimethylammonium chloride surfactant. Formulations 2-7 and 2-8 included a pentyl trimethylammonium chloride surfactant. Formulations 2-1 and 2-7 included no stability additive (e.g., controls). Formulation 2-2 included 1.88% SXS. Formulation 2-3 included 3% Na-PTSA. Formulation 2-4 included 2% sodium nitrate. Formulation 2-5 included 2% 2,3,5, SMS. Formulation 2-6 included 2% 2,4,6 SMS. Formulation 2-8 included 0.25% 2,4,6 SMS. Each formulation included 1% of the applicable alkyl trimethyl ammonium chloride surfactant, 1% sodium hypochlorite (Clorox® Germicidal Bleach sodium hypochlorite solution), and 2.5% of an anhydrous reagent grade sodium carbonate buffer.

TABLE 2

| Formulation | Components | Wt % Actives | Bleach retention at 28 days, % |
|---|---|---|---|
| 2-1 (no additive) | AMMONYX ® CETAC | 1% | 0 |
| | $Na_2CO_3$ | 2.5% | |
| | NaOCl | 1% | |
| | DI-water | Balance | |
| 2-2 (SXS additive) | AMMONYX ® CETAC | 1% | 25 |
| | $Na_2CO_3$ | 2.5% | |
| | NaOCl | 1% | |
| | SXS | 1.88% | |
| | DI-water | Balance | |
| 2-3 (Na-PTSA additive) | AMMONYX ® CETAC | 1% | 14 |
| | $Na_2CO_3$ | 2.5% | |
| | NaOCl | 1% | |
| | Na-PTSA | 3% | |
| | DI-water | Balance | |
| 2-4 ($NaNO_3$ additive) | AMMONYX ® CETAC | 1% | precipitates |
| | $Na_2CO_3$ | 2.5% | |
| | NaOCl | 1% | |
| | $NaNO_3$ | 2% | |
| | DI-water | Balance | |
| 2-5 (2,3,5 SMS additive) | AMMONYX ® CETAC | 1% | 1.1 |
| | $Na_2CO_3$ | 2.5% | |
| | NaOCl | 1% | |
| | 2,3,5 SMS | 2% | |
| | DI-water | Balance | |
| 2-6 (2,4,6 SMS additive) | AMMONYX ® CETAC | 1% | 51 |
| | $Na_2CO_3$ | 2.5% | |
| | NaOCl | 1% | |
| | 2,4,6 SMS | 2% | |
| | DI water | Balance | |
| 2-7 (no additive) | Pentyl trimethyl-ammonium chloride | 1% | 0 |
| | $Na_2CO_3$ | 2.5% | |
| | NaOCl | 1% | |
| | DI water | Balance | |
| 2-8 (2,4,6 SMS additive) | Pentyl trimethyl-ammonium chloride | 1% | 61 |
| | $Na_2CO_3$ | 2.5% | |
| | NaOCl | 1% | |
| | 2,4,6 SMS | 0.25% | |
| | DI water | Balance | |

The results in Table 2 show that bleach retention in the formulations comprising either cationic surfactant is very poor, with no hypochlorite remaining after 28 days aging at 49° C. The addition of SXS or Na-PTSA to formulations comprising AMMONYX® CETAC can provide some boost to the bleach retention relative to the control, but retention is still very low (25% and about 14%, respectively).

The results of formulation 2-6 in Table 2 show that the addition of 2,4,6 SMS to a formulation comprising micelles of AMMONYX® CETAC provides a much more significant boost (to over 50%) to the retention of hypochlorite than that provided by other aryl sulfonates. As shown by formulation 2-5, the addition of 2,3,5 SMS provides essentially no improvement to hypochlorite retention over that provided by the control.

The results of formulation 2-8 in Table 2 also show that the addition of 2,4,6 SMS to a formulation comprising micelles of a cationic surfactant with short alkyl chains such as pentyl trimethyl ammonium chloride also provides a surprisingly large boost (to 61%) to stability of the hypochlorite.

Example 3

Bleach Retention of Formulations Comprising Amphoteric Surfactant Micelles and Additives Table 3 shows compositional and bleach stability data for Formulations 3-1 through 3-6. Formulation 3-1 included no stability additive (e.g., the control). Formulation 3-2 included 4% SXS. Formulation 3-3 included 3% Na-PTSA. Formulation 3-4 included 4% sodium nitrate. Formulation 3-5 included 1.5% 2,3,5 SMS. Formulation 3-6 included 1.5% 2,4,6 SMS. Each formulation included 1% AMMONYX® LO, a lauryl dimethyl amine oxide surfactant, 1% sodium hypochlorite (Clorox® Germicidal Bleach sodium hypochlorite solution), and 2.5% of an anhydrous reagent grade sodium carbonate buffer.

TABLE 3

| Formulation | Components | Wt % Actives | Bleach retention at 28 days, % |
|---|---|---|---|
| 3-1 (no additive) | AMMONYX ® LO | 1% | 0 |
| | $Na_2CO_3$ | 2.5 | |
| | NaOCl | 1 | |
| | DI-water | Balance | |
| 3-2 (SXS additive) | AMMONYX ® LO | 1% | 0 |
| | $Na_2CO_3$ | 2.5 | |
| | NaOCl | 1% | |
| | SXS | 4% | |
| | DI-water | Balance | |
| 3-3 (Na-PTSA additive) | AMMONYX ® LO | 1% | 0 |
| | $Na_2CO_3$ | 2.5 | |
| | NaOCl | 1 | |
| | Na-PTSA | 3% | |
| | DI-water | Balance | |
| 3-4 ($NaNO_3$ additive) | AMMONYX ® LO | 1% | 0 |
| | $Na_2CO_3$ | 2.5 | |
| | NaOCl | 1 | |
| | $NaNO_3$ | 4% | |
| | DI-water | Balance | |
| 3-5 (2,3,5 SMS additive) | AMMONYX ® LO | 1% | 0 |
| | $Na_2CO_3$ | 2.5 | |
| | NaOCl | 1 | |
| | 2,3,5 SMS | 1.5% | |
| | DI-water | Balance | |
| 3-6 (2,4,6 SMS additive) | AMMONYX ® LO | 1% | 58 |
| | $Na_2CO_3$ | 2.5 | |
| | NaOCl | 1 | |
| | 2,4,6 SMS | 1.5% | |
| | DI-water | Balance | |

Table 3 shows the stability of hypochlorite formulations comprising an amphoteric amine oxide surfactant (e.g., lauryl dimethyl amine oxide). Amphoteric surfactants may exhibit a change in their net charge as a function of the pH of the aqueous solution. Amine oxide surfactants may exhibit a cationic charge due to protonation of the amine oxide headgroups at relatively low pH, for example pH 2, while they will be uncharged at relatively high pH, for example, pH 11. The pKa value of amine oxide surfactants is typically about 4.5. Thus, near pH 4.5, about 50% of the amine oxide molecules will be cationically charged, and 50% will be uncharged. Because the formulations in Table 3 comprise a sodium carbonate buffer and thus exhibit a pH near 11.0, the amphoteric amine oxide surfactant present in these formulations may be completely uncharged.

In each example, including Example 3, the bleach retention values were determined for each additive at increasing concentrations in the formulations with all other concentrations remaining fixed. Thus, the bleach retention values reported refer to formulations in which the additive level may be approximately optimal, yielding the greatest bleach retention observed at the lowest additive concentration. As is readily apparent from Table 3, all of the formulations, other than formulation 3-6 (including the 2,4,6 SMS) showed 0% hypochlorite retention after 28 days. In order to distinguish the bleach retention of formulations comprising different levels of a given additive, there must be some measurable hypochlorite remaining in the formulations. Thus, information about the bleach retention as a function of time, i.e. information about the kinetics of the bleach loss, is measured at a period before 28 days. While no detectable hypochlorite remained within formulations 3-1 through 3-5 after 28 days, samples of the formulations were analyzed (via titration) at additional intermediate time points over the test period of 28 days.

Specifically, the bleach retention of all formulations was measured at 7, 14, 21 and 28 days of aging at 49° C. In the case of rather unstable formulations, the bleach retention observed at shorter aging times, such as 7 or 14 days, as a function of the additive level was used to determine the optimum additive level. The final results obtained at 28 days reported in Table 3 for each of the formulations are for the optimum additive levels.

The results in Table 3 indicate that the control formulation (formulation 3-1) comprising the amphoteric surfactant has no bleach remaining after aging 28 days at 49° C., and is thus a very unstable formulation. Addition of SXS or Na-PTSA (formulations 3-2 and 3-3), even at levels which showed optimum bleach retention at shorter times, does not improve the bleach retention at 28 days over the control. The general characterization of amphoteric surfactants such as amine oxides in formulations with hypochlorite as stable, believed to be taught in existing art, thus does not provide a method by which to select additives for formulations where it is desired that a significant quantity of the hypochlorite bleach be retained after a period of 28 days storage at 49° C.

The results of formulation 3-6 in Table 3 also indicate, surprisingly, that the addition of 2,4,6 SMS to the formulation comprising the amphoteric surfactant results in a significant boost in bleach retention, even after 28 days aging at 49° C. The 58% hypochlorite retention of formulation 3-6 is very surprising, particularly when compared to the 0% retention of formulations 3-2, 3-3, and 3-5, including other aryl sulfonates.

Example 4

Bleach Retention of Formulations Comprising Mixed Micelles of Cationic and Anionic Surfactants and 2,4,6 SMS Table 4 shows compositional and bleach stability data for Formulations 4-1 through 4-11. Each formulation included a mix of cationic (AMMONYX® CETAC) and anionic (i.e. sodium lauryl sulfate, "SLS") surfactants, at different ratios. Each formulation included 4% 2,4,6 SMS, 1% total surfactant, 1% sodium hypochlorite (Clorox® Germicidal Bleach sodium hypochlorite solution), and 2.5% of an anhydrous reagent grade sodium carbonate buffer.

TABLE 4

| Formulation | Components | Wt % Actives | Bleach retention at 28 days, % |
|---|---|---|---|
| 4-1 | SLS | 0.95% | 53 |
| | AMMONYX ® CETAC | 0.05% | |
| | $Na_2CO_3$ | 2.5% | |
| | NaOCl | 1% | |
| | 2,4,6 SMS | 4% | |
| | DI water | Balance | |
| 4-2 | SLS | 0.9% | 56 |
| | AMMONYX ® CETAC | 0.1% | |
| | $Na_2CO_3$ | 2.5% | |
| | NaOCl | 1% | |
| | 2,4,6 SMS | 4% | |
| | DI water | Balance | |
| 4-3 | SLS | 0.8% | 51 |
| | AMMONYX ® CETAC | 0.2% | |
| | $Na_2CO_3$ | 2.5% | |
| | NaOCl | 1% | |
| | 2,4,6 SMS | 4% | |
| | DI water | Balance | |
| 4-4 | SLS | 0.7% | 57 |
| | AMMONYX ® CETAC | 0.3% | |
| | $Na_2CO_3$ | 2.5% | |
| | NaOCl | 1% | |
| | 2,4,6 SMS | 4% | |
| | DI water | Balance | |
| 4-5 | SLS | 0.6% | 50 |
| | AMMONYX ® CETAC | 0.4% | |
| | $Na_2CO_3$ | 2.5% | |
| | NaOCl | 1% | |
| | 2,4,6 SMS | 4% | |
| | DI water | Balance | |
| 4-6 | SLS | 0.5% | 50 |
| | AMMONYX ® CETAC | 0.5% | |
| | $Na_2CO_3$ | 2.5% | |
| | NaOCl | 1% | |
| | 2,4,6 SMS | 4% | |
| | DI water | Balance | |
| 4-7 | SLS | 0.4% | 56 |
| | AMMONYX ® CETAC | 0.6% | |
| | $Na_2CO_3$ | 2.5% | |
| | NaOCl | 1% | |
| | 2,4,6 SMS | 4% | |
| | DI water | Balance | |
| 4-8 | SLS | 0.3% | 60 |
| | AMMONYX ® CETAC | 0.7% | |
| | $Na_2CO_3$ | 2.5% | |
| | NaOCl | 1% | |
| | 2,4,6 SMS | 4% | |
| | DI water | Balance | |
| 4-9 | SLS | 0.2% | 59 |
| | AMMONYX ® CETAC | 0.8% | |
| | $Na_2CO_3$ | 2.5% | |
| | NaOCl | 1% | |
| | 2,4,6 SMS | 4% | |
| | DI water | Balance | |
| 4-10 | SLS | 0.1% | 56 |
| | AMMONYX ® CETAC | 0.9% | |
| | $Na_2CO_3$ | 2.5% | |
| | NaOCl | 1% | |
| | 2,4,6 SMS | 4% | |
| | DI water | Balance | |
| 4-11 | SLS | 0.05% | 51 |
| | AMMONYX ® CETAC | 0.95% | |
| | $Na_2CO_3$ | 2.5% | |
| | NaOCl | 1% | |
| | 2,4,6 SMS | 4% | |
| | DI water | Balance | |

In the formulations above, the boosting of bleach retention in formulations comprising anionic and cationic surfactants through the addition of 2,4,6 SMS was clearly demonstrated across a wide range of ratios of anionic to cationic surfactant concentrations. The composition of the mixed micelles was varied by changing the relative amounts of SLS and AMMONYX® CETAC in the formulation, while the total surfactant concentration was fixed at 1% by weight. In addition, the initial sodium hypochlorite concentration (1%) and the sodium carbonate buffer concentration (2.5%) were the same as in Examples 1 and 2. The anionic surfactant was the same SLS as used in Example 1, and the AMMONYX® CETAC was the same as used in Example 2.

The results in Table 4 show that the addition of an appropriate amount of 2,4,6 SMS to mixed micelles comprising an anionic surfactant and a cationic surfactant yields bleach retention levels after aging which are 50% or greater across a wide range of anionic surfactant to cationic surfactant ratios. In other words, over the entire range of tested compositions of the mixed micelles, i.e., from systems which are rich in anionic surfactant (formulation 4-1) to systems which are rich in cationic surfactant (formulation 4-11). Formulation 4-1 has a ratio of anionic to cationic surfactant of 1:19, while formulation 4-11 has a ratio of anionic to cationic surfactant of 19:1.

Since the net charge on the mixed micelles of anionic and cationic surfactants will change with the relative amounts of each surfactant present, the results in Table 4 also indicate that the chaotropic interactions between 2,4,6 SMS and the mixed micelles are useful in boosting bleach retention independent of the net charge or composition of the mixed micelles, consistent with Examples 1 and 2, in which the addition of 2,4,6 SMS boosted the bleach retention of micelles with either anionic or cationic charges only. This is a further indication that the interactions of the 2,4,6 SMS with micelles are chaotropic in origin, and not directly related or controlled by the electrostatic charges present on the micelles.

The addition of 2,4,6 SMS may also change the phase behavior of such mixed micelle systems. For example, the 2,4,6 SMS was included at 4% by weight in each formulation of Example 4 to ensure that all of the mixtures were soluble at 49° C. At lower concentrations of 2,4,6 SMS, some systems may precipitate.

Example 5

Bleach Retention of Formulations Comprising Mixed Micelles of Cationic and Anionic Surfactants and 2,4,6 SMS Table 5 shows compositional and bleach stability data for formulations 5-1 through 5-10. Each formulation included a mix of cationic (pentyl trimethylammonium chloride) and anionic (SLS) surfactants, at different ratios. Each formulation included 0.25% 2,4,6 SMS, 1% total surfactant, 1% sodium hypochlorite (Clorox® Germicidal Bleach sodium hypochlorite solution), and 2.5% of an anhydrous reagent grade sodium carbonate buffer.

TABLE 5

| Formulation | Components | Wt % Actives | Bleach retention at 28 days, % |
|---|---|---|---|
| 5-1 | SLS | 0.09% | 61 |
| | Pentyl trimethyl-ammonium chloride | 0.91% | |
| | $Na_2CO_3$ | 2.5% | |
| | NaOCl | 1% | |
| | 2,4,6 SMS | 0.25% | |
| | DI water | To balance | |
| 5-2 | SLS | 0.18% | 59 |
| | Pentyl trimethyl-ammonium chloride | 0.82% | |
| | $Na_2CO_3$ | 2.5% | |
| | NaOCl | 1% | |

TABLE 5-continued

| Formulation | Components | Wt % Actives | Bleach retention at 28 days, % |
|---|---|---|---|
| | 2,4,6 SMS | 0.25% | |
| | DI water | To balance | |
| 5-3 | SLS | 0.27% | 69 |
| | Pentyl trimethyl-ammonium chloride | 0.73% | |
| | $Na_2CO_3$ | 2.5% | |
| | NaOCl | 1% | |
| | 2,4,6 SMS | 0.25% | |
| | DI water | To balance | |
| 5-4 | SLS | 0.36% | 59 |
| | Pentyl trimethyl-ammonium chloride | 0.64% | |
| | $Na_2CO_3$ | 2.5% | |
| | NaOCl | 1% | |
| | 2,4,6 SMS | 0.25% | |
| | DI water | To balance | |
| 5-5 | SLS | 0.45% | 61 |
| | Pentyl trimethyl-ammonium chloride | 0.55% | |
| | $Na_2CO_3$ | 2.5% | |
| | NaOCl | 1% | |
| | 2,4,6 SMS | 0.25% | |
| | DI water | To balance | |
| 5-6 | SLS | 0.55% | 60 |
| | Pentyl trimethyl-ammonium chloride | 0.45% | |
| | $Na_2CO_3$ | 2.5% | |
| | NaOCl | 1% | |
| | 2,4,6 SMS | 0.25% | |
| | DI water | To balance | |
| 5-7 | SLS | 0.64% | 55 |
| | Pentyl trimethyl-ammonium chloride | 0.36% | |
| | $Na_2CO_3$ | 2.5% | |
| | NaOCl | 1% | |
| | 2,4,6 SMS | 0.25% | |
| | DI water | To balance | |
| 5-8 | SLS | 0.73% | 63 |
| | Pentyl trimethyl-ammonium chloride | 0.27% | |
| | $Na_2CO_3$ | 2.5% | |
| | NaOCl | 1% | |
| | 2,4,6 SMS | 0.25% | |
| | DI water | To balance | |
| 5-9 | SLS | 0.82% | 57 |
| | Pentyl trimethyl-ammonium chloride | 0.18% | |
| | $Na_2CO_3$ | 2.5% | |
| | NaOCl | 1% | |
| | 2,4,6 SMS | 0.25% | |
| | DI water | To balance | |
| 5-10 | SLS | 0.91% | 54 |
| | Pentyl trimethyl-ammonium chloride | 0.09% | |
| | $Na_2CO_3$ | 2.5% | |
| | NaOCl | 1% | |
| | 2,4,6 SMS | 0.25% | |
| | DI water | To balance | |

The results in Table 5 show that the addition of an appropriate amount of 2,4,6 SMS to mixed micelles comprising an anionic surfactant such as SLS and a cationic surfactant such as pentyl trimethylammonium chloride yields bleach retention levels which again are 50% or better after aging 28 days at 49° C., over the entire range of tested compositions of the mixed micelles, i.e., from systems which are rich in cationic surfactant (formulation 5-1) to systems which are rich in anionic surfactant (formulation 5-10). Formulation 5-1 has a ratio of anionic to cationic surfactant of 1:10, while formulation 5-10 has a ratio of anionic to cationic surfactant of 10:1.

Example 5 clearly demonstrates boosting of bleach retention, even when the cationic surfactant is considerably more hydrophilic, e.g., it has a short methylene chain tail of 5 carbons as compared to the 16 carbons of the AMMONYX® CETAC of Example 4. The results indicate that the association of the 2,4,6 SMS with mixed anionic-cationic micelles is not strongly affected by the nature of the methylene chain tails of the surfactant. The method of determining the optimum amount of 2,4,6 SMS needed to boost bleach retention, in which a range of additive concentrations were tested after aging at 49° C., followed by the selection of the lowest level of 2,4,6 SMS needed to meet a desired bleach retention, was again followed. 0.25% 2,4,6, SMS is sufficient to achieve a hypochlorite retention level of 50% or more after 28 days storage at 49° C.

Example 6

Bleach Retention of Formulations Comprising Mixed Micelles of Amphoteric and Anionic Surfactants and 2,4,6 SMS Table 6 shows compositional and bleach stability data for formulations 6-1 through 6-10. Each formulation included a mix of amphoteric (AMMONYX® LO) and anionic (SLS) surfactants, at different ratios. Each formulation included 1.5% 2,4,6 SMS, 1% total surfactant, 1% sodium hypochlorite (Clorox® Germicidal Bleach sodium hypochlorite solution), and 2.5% of an anhydrous reagent grade sodium carbonate buffer.

TABLE 6

| Formulation | Components | Wt % Actives | Bleach retention at 28 days, % |
|---|---|---|---|
| 6-1 | SLS | 0.09 | 54 |
| | AMMONYX ® LO | 0.91 | |
| | $Na_2CO_3$ | 2.5% | |
| | NaOCl | 1% | |
| | 2,4,6 SMS | 1.5% | |
| | DI-water | Balance | |
| 6-2 | SLS | 0.18 | 62 |
| | AMMONYX ® LO | 0.82 | |
| | $Na_2CO_3$ | 2.5% | |
| | NaOCl | 1% | |
| | 2,4,6 SMS | 1.5% | |
| | DI-water | Balance | |
| 6-3 | SLS | 0.27 | 53 |
| | AMMONYX ® LO | 0.73 | |
| | $Na_2CO_3$ | 2.5% | |
| | NaOCl | 1% | |
| | 2,4,6 SMS | 1.5% | |
| | DI-water | Balance | |
| 6-4 | SLS | 0.36 | 61 |
| | AMMONYX ® LO | 0.64 | |
| | $Na_2CO_3$ | 2.5% | |
| | NaOCl | 1% | |
| | 2,4,6 SMS | 1.5% | |
| | DI-water | Balance | |
| 6-5 | SLS | 0.45 | 62 |
| | AMMONYX ® LO | 0.55 | |
| | $Na_2CO_3$ | 2.5% | |
| | NaOCl | 1% | |
| | 2,4,6 SMS | 1.5% | |
| | DI-water | Balance | |
| 6-6 | SLS | 0.55 | 59 |
| | AMMONYX ® LO | 0.45 | |
| | $Na_2CO_3$ | 2.5% | |
| | NaOCl | 1% | |

TABLE 6-continued

| Formulation | Components | Wt % Actives | Bleach retention at 28 days, % |
|---|---|---|---|
| | 2,4,6 SMS | 1.5% | |
| | DI-water | Balance | |
| 6-7 | SLS | 0.64 | 71 |
| | AMMONYX ® LO | 0.36 | |
| | $Na_2CO_3$ | 2.5% | |
| | NaOCl | 1% | |
| | 2,4,6 SMS | 1.5% | |
| | DI-water | Balance | |
| 6-8 | SLS | 0.73 | 64 |
| | AMMONYX ® LO | 0.27 | |
| | $Na_2CO_3$ | 2.5% | |
| | NaOCl | 1% | |
| | 2,4,6 SMS | 1.5% | |
| | DI-water | Balance | |
| 6-9 | SLS | 0.82 | 69 |
| | AMMONYX ® LO | 0.18 | |
| | $Na_2CO_3$ | 2.5% | |
| | NaOCl | 1% | |
| | 2,4,6 SMS | 1.5% | |
| | DI-water | Balance | |
| 6-10 | SLS | 0.91 | 62 |
| | AMMONYX ® LO | 0.09 | |
| | $Na_2CO_3$ | 2.5% | |
| | NaOCl | 1% | |
| | 2,4,6 SMS | 1.5% | |
| | DI-water | Balance | |

The results in Table 6 indicate that the addition of 2,4,6 SMS to formulations comprising mixed micelles of an anionic and an amphoteric surfactant and hypochlorite can provide a boost to bleach retention upon aging across the entire range of tested mixed micelle compositions. The ratio of anionic to amphoteric surfactant ranged from 1:10 to 10:1. As in other described examples, the bleach retention of the formulations across different mixed micelle compositions, from anionic-rich to amphoteric-rich, was monitored with increasing levels of 2,4,6 SMS, as a function of aging time at 49° C. These investigations confirmed that, for the constant total surfactant level of 1% selected, and for the 1% hypochlorite concentration selected, that the addition of 1.5% 2,4,6 SMS would be approximately the minimum amount required to provide boosting of the bleach retention to 50% or better after aging 28 days at 49° C. for this particular mixed micelle formulation across the complete range of mixed micelle compositions. As noted in other examples, the bleach retention of the individual surfactants at the same total surfactant concentration of 1%, the same sodium carbonate concentration (2.5%), and the same hypochlorite concentration (1%), was much poorer in the absence of 2,4,6 SMS or in the presence of some other aryl sulfonate known to the art, such as SXS or Na-PTSA.

Example 7

Bleach Retention of Formulations Comprising Mixed Micelles of Anionic and Nonionic Surfactants and 2,4,6 SMS Table 7 shows compositional and bleach stability data for formulations 7-1 through 7-4. Each formulation included a mix of anionic (SLS) and nonionic surfactants (BIO-SOFT® N91-6). BIO-SOFT® N91-6 is an alkyl ethoxylate surfactant where the methylene chain length is from C9 to C11 and having an average of 6 moles of ethoxylation. Each formulation included 2% 2,4,6 SMS, 1% total surfactant, 1% sodium hypochlorite (Clorox® Germicidal Bleach sodium hypochlorite solution), and 2.5% of an anhydrous reagent grade sodium carbonate buffer.

TABLE 7

| For-mulation | Components | Wt % Actives | Bleach retention at 28 days, % |
|---|---|---|---|
| 7-1 | SLS | 0.8 wt % | 60 |
| | BIO-SOFT ® N91-6 | 0.2% | |
| | $Na_2CO_3$ | 2.5% | |
| | NaOCl | 1% | |
| | 2,4,6 SMS | 2% | |
| | DI water | Balance | |
| 7-2 | SLS | 0.6% | 50 |
| | BIO-SOFT ® N91-6 | 0.4% | |
| | $Na_2CO_3$ | 2.5% | |
| | NaOCl | 1% | |
| | 2,4,6 SMS | 2% | |
| | DI water | To balance | |
| 7-3 | SLS | 0.4% | 36 |
| | BIO-SOFT ® N91-6 | 0.6% | |
| | $Na_2CO_3$ | 2.5% | |
| | NaOCl | 1% | |
| | 2,4,6 SMS | 2% | |
| | DI water | To balance | |
| 7-4 | SLS | 0.2% | 24 |
| | BIO-SOFT ® N91-6 | 0.8% | |
| | $Na_2CO_3$ | 2.5% | |
| | NaOCl | 1% | |
| | 2,4,6 SMS | 2% | |
| | DI water | To balance | |

The results in Table 7 indicate that the addition of 2,4,6 SMS to formulations comprising mixed micelles of an anionic surfactant and a nonionic surfactant (an alkyl or alcohol ethoxylate) and hypochlorite can provide bleach retention boosting over a range of mixed micelle compositions having different ratios of anionic surfactant to nonionic surfactant. The method of evaluation of the bleach retention boosting via the kinetic monitoring of the bleach retention of these mixed micelles by aging at 49° C., with various levels of 2,4,6 SMS incorporated into mixed micelle systems across a range of compositions, from anionic-rich to nonionic-rich, also can be used to indicate the range of mixed micelle compositions which might be expected to exhibit 50% or better hypochlorite retention after 28 days at 49° C. Thus, at a constant total surfactant concentration of 1%, incorporation of 0.4% or more (40% relative of the surfactant package) of the alcohol ethoxylate is possible while maintaining bleach retention of at least 50%. This result (i.e., that relatively high levels of alcohol ethyoxylate surfactant can be included, while maintaining a relatively high bleach retention) is surprising because it is known that alcohol ethoxylate surfactants readily react with sodium hypochlorite, causing significant bleach loss.

Even at mixed micelle compositions comprising greater than 40% relative of the alcohol ethoxylate, significant retention of bleach is still observed when 2,4,6 SMS is present in the formulation. Thus, depending on the desired hypochlorite concentration or retention, the addition of 2,4,6 SMS to compositions comprising mixed micelles of an anionic surfactant and a nonionic surfactant could be used to deliver formulations at somewhat lower hypochlorite concentrations or retention values, with mixed micelles that are nonionic-rich. In other words, where lower bleach retention is acceptable, higher concentrations of alcohol ethoxylate can be employed.

The results also indicate that the chaotropic interactions between 2,4,6 SMS and mixed micelles of anionic and nonionic surfactant can provide a surprising boost in bleach retention even when the nonionic surfactant is known to be relatively reactive with hypochlorite. The Examples collectively demonstrate that the benefits to bleach retention achieved via the addition of 2,4,6 SMS to various surfactant containing hypochlorite formulations are not unique to a single surfactant type, and are surprisingly robust.

Example 8

Determination of Bleach Retention Boosting Benefits of 2,4,6 SMS in Formulations Comprising Sulfonate and Ethoxysulfate Surfactants The bleach boosting benefits of 2,4,6 SMS in formulations comprising hypochlorite, sodium carbonate, and micelles of either an ethoxysulfate (Steol® CS-230, sodium salt) or an aromatic sulfonate (BIO-SOFT® S-101, sodium salt) surfactant were investigated as a function of the level of 2,4,6 SMS incorporated over time. Steol® CS-230 is an alkyl ethoxysulfate (available from Stepan Co.), and BIO-SOFT® S-101 is an alkylbenzene sulfonate (available from Stepan Co.).

The surfactant level was fixed at 1% by weight, the carbonate level was fixed at 2.5% by weight, and the initial concentration of sodium hypochlorite was 1% by weight. Six formulations of each surfactant type were prepared, containing 0% 2,4,6 SMS as a control, and five levels of 2,4,6 SMS over the range 1% to 5% by weight. The formulations were stored in glass test tubes at 49° C. in a water bath. At 7, 14, 21 and 28 days, the sodium hypochlorite concentrations were determined via titration. Table 8 summarizes the results, where the percentage bleach retention refers to the percentage of the original sodium hypochlorite concentration found in the sample on the day it was measured.

TABLE 8

| | 2,4,6 SMS wt % | | | | | |
|---|---|---|---|---|---|---|
| | 0 | 1 | 2 | 3 | 4 | 5 |
| Day 7 | | | | | | |
| 1% Steol ® CS-230, % bleach retention | 37 | 86 | 86 | 80 | 85 | 74 |
| 1% BIO-SOFT ® S-101, % bleach retention | 82 | 79 | 79 | 78 | 76 | 74 |
| Day 14 | | | | | | |
| 1% Steol ® CS-230, % bleach retention | 1 | 74 | 73 | 67 | 63 | 57 |
| 1% BIO-SOFT ® S-101, % bleach retention | 60 | 61 | 62 | 60 | 58 | 52 |
| Day 21 | | | | | | |
| 1% Steol ® CS-230, % bleach retention | 0 | 60 | 59 | 53 | 47 | 38 |
| 1% BIO-SOFT ® S-101, % bleach retention | 31 | 46 | 47 | 44 | 41 | 35 |
| Day 28 | | | | | | |
| 1% Steol ® CS-230, % bleach retention | 0 | 50 | 50 | 43 | 36 | 29 |
| 1% Bio-SOFT ® S-101, % bleach retention | 7 | 35 | 37 | 33 | 29 | 23 |

The results indicate that, with no added 2,4,6 SMS (0%), the bleach retention of the formulations quickly decreases with aging, and the results show a difference in bleach retention between the two surfactants, with Bio-SOFT® S-101 showing better retention as early as after 7 days.

The results in Table 8 indicate that the addition of 1% 2,4,6 SMS to the formulation with Steol® CS-230 boosts the bleach retention from 0% to 50% after 28 days aging, and it appears that higher levels of 2,4,6 SMS do not add to the bleach retention of this formulation.

The results in Table 8 also indicate that the addition of 2,4,6 SMS gives a very significant boost to the bleach retention of the formulations comprising Biosoft S-101 surfactant, with the magnitude of the benefit of the addition of 2,4,6 SMS clearly showing at 21 days or more. The data may suggest that the maximum in bleach retention boosting by 2,4,6 SMS is somewhat less for BIO-SOFT® S-101 compared to Steol® CS-230. For example, after 28 days the BIO-SOFT® S-101 formulations show retention in the 25-40% range, while the Steol® CS-230 formulations show retention in the 30-50% range.

Example 9

Bleach Retention Boosting by 2,4,6 SMS in Formulations Comprising Water-Insoluble Solvent and Hypochlorite The incorporation of significant amounts of water-insoluble components such a fragrance oils or other oils or solvents into cleaning formulations to form so-called microemulsions can be important for modulating the aesthetics and/or the cleaning performance of the formulations. Such components, even when solubilized into formulations comprising hypochlorite, often cause unacceptable loss of hypochlorite upon aging. In other words, the reaction of hypochlorite with these oils is not eliminated merely because the oils are solubilized by surfactants.

The boost in bleach retention achieved with the addition of 2,4,6 SMS provides formulations which can include significant amounts of water-insoluble oils with significantly improved retention of hypochlorite, even after aging at 49° C.

As an example, SLS was used to solubilize a water-insoluble oil or solvent, M1214, across a range of oil concentrations, with formulations also comprising sodium hypochlorite. M1214 is a C12-C14 dimethylamide and was obtained from Stepan Co.

From a practical perspective, it is desirable for liquid formulations to remain single phase across a range of temperatures, i.e., the oil should not separate out or cause cloudiness of the formulations where a clear product is desired. For a given surfactant-oil combination, the addition of other water soluble components which are not true surfactants, such as SXS, may increase the solubilization of the oil or modify the robustness of the formulation to changes in temperature.

Initial investigations of formulations comprising 1% and even 2% SLS, in the presence of 2.5% sodium carbonate and 1% sodium hypochlorite, and also comprising between 0.25% and 1% M1214 solvent were not all clear at room temperature and at 49° C. As such, SLS may be a relatively poor choice for the solubilization of this solvent in the formulation comprising the relatively high concentration of soluble electrolytes provided by the hypochlorite and carbonate. The addition of 2,4,6 SMS at 1.5% by weight to the same formulations provided an improvement in the oil solubility across the range of oil levels of interest. The addition of 2,4,6 SMS at 3% showed an even greater improvement, providing formulations which were clear at both room temperature and 49° C. across the entire range of oil concentrations of interest.

Thus, the addition of the 2,4,6 SMS provided a significant boost to oil solubilization at desirably low surfactant/oil ratios, for example, 1% surfactant to 1% M1214, which was clear at both room temperature and 49° C. Thus, an increase of the surfactant concentration to 2% to ensure robust solubilization of the oil was not necessary, where 2,4,6 SMS is included. Applicants speculate, without being bound by theory, that the significant chaotropic interactions of 2,4,6 SMS with the surfactant micelles that deliver boosting of bleach retention also are beneficial for adjusting surfactant-oil interactions in micellar or microemulsion aggregates, reducing the amount of surfactant needed to solubilize the oil.

The bleach retention of these formulations aged at 49° C. was also studied and the results are reported in Table 9.

TABLE 9

| Formulation | Components | Wt % Actives | Bleach retention at 28 days, % |
|---|---|---|---|
| 9-1 | SLS | 1.0 | 15 |
| | M1214 | 0 | |
| | $Na_2CO_3$ | 2.5 | |
| | NaOCl | 1.0 | |
| | 2,4,6 SMS | 0 | |
| | DI water | Balance | |
| 9-2 | SLS | 2.0 | 16 |
| | M1214 | 0 | |
| | $Na_2CO_3$ | 2.5 | |
| | NaOCl | 1.0 | |
| | 2,4,6 SMS | 0 | |
| | DI water | Balance | |
| 9-3 | SLS | 1.0 | 55 |
| | M1214 | 0 | |
| | $Na_2CO_3$ | 2.5 | |
| | NaOCl | 1.0 | |
| | 2,4,6 SMS | 3.0 | |
| | DI water | Balance | |
| 9-4 | SLS | 2.0 | 56 |
| | M1214 | 0 | |
| | $Na_2CO_3$ | 2.5 | |
| | NaOCl | 1.0 | |
| | 2,4,6 SMS | 3.0 | |
| | DI water | Balance | |
| 9-5 | SLS | 1 | 54 |
| | M1214 | 0.25 | |
| | $Na_2CO_3$ | 2.5 | |
| | NaOCl | 1 | |
| | 2,4,6 SMS | 3 | |
| | DI water | Balance | |
| 9-6 | SLS | 1 | 48 |
| | M1214 | 0.5 | |
| | $Na_2CO_3$ | 2.5 | |
| | NaOCl | 1 | |
| | 2,4,6 SMS | 3 | |
| | DI water | Balance | |
| 9-7 | SLS | 1 | 49 |
| | M1214 | 0.75 | |
| | $Na_2CO_3$ | 2.5 | |
| | NaOCl | 1 | |
| | 2,4,6 SMS | 3 | |
| | DI water | Balance | |
| 9-8 | SLS | 1 | 42 |
| | M1214 | 1 | |
| | $Na_2CO_3$ | 2.5 | |
| | NaOCl | 1 | |
| | 2,4,6 SMS | 3 | |
| | DI water | Balance | |

The results in Table 9 show that the addition of 2,4,6 SMS to formulations comprising sodium hypochlorite, sodium carbonate, and SLS at different concentrations yields significant boosting of the bleach retention upon aging 28 days at 49° C. Formulations 9-5 through 9-8 shown in Table 9 also show that the addition of 2,4,6 SMS at 3% provides a significant boost to bleach retention in formulations including an insoluble oil such as M1214, even across a wide range of oil concentrations. Applicants speculate, without being bound by theory, that the chaotropic interactions of 2,4,6 SMS with surfactant aggregates provide a boost to the bleach retention of such systems by reducing or eliminating access to and reaction with the hypochlorite for components held within the aggregates. This benefit advantageously occurs whether the surfactant aggregates are swollen with a significant amount of water-insoluble oil (where oil is present in the system), or not (where oil is not present in the system). As such, components within the aggregate may be protected from reaction with the hypochlorite. In other words, both the surfactant molecules and any additional components of the aggregate, such as solubilized water-insoluble oils, fragrances, etc. may be protected within the aggregate.

As such, the bleach retention boosting mechanism provided by 2,4,6 SMS does not depend on the particular nature of the surfactants or oils comprising the aggregates, although the structure of the surfactants and oils may determine their inherent reactivity with hypochlorite. The use of 2,4,6 SMS may thus allow inclusion of fragrances, oils, or other components that are relatively reactive with hypochlorite in a relatively stable liquid, by protecting such reactive components from interaction with the hypochlorite.

Example 10

Bleach Retention Boosting from Addition of 2,4,6 SMS to Formulations Comprising an Anionic Surfactant, Hypochlorite, Sodium Carbonate, and Sodium Hydroxide The addition of sodium hydroxide (caustic) is often employed to increase bleach retention. As the level of caustic added to formulations increases, the pH will tend to rise, and the potential for skin irritation and attack of some household surfaces, such as interior and exterior architectural coatings can also rise. In an effort to provide hypochlorite cleaners with more mild pH characteristics, caustic levels can be minimized through the addition of other buffers, such as sodium carbonate.

The effect of the addition of 2,4,6 SMS on the bleach retention to a formulation comprising an 1% SLS, 1% hypochlorite, and varying amounts of sodium hydroxide and sodium carbonate is shown in Table 10. Formulations were prepared and aged at 49° C. for 7, 14, 21 and 28 days. After aging, the remaining hypochlorite levels were determined via titration. Only the final data at 28 days of aging is shown in Table 10. As different levels of sodium hydroxide were added to the formulations, the initial pH of the formulations varied, being higher in the case of added sodium hydroxide, and lower in its absence.

TABLE 10

| | $Na_2CO_3$ wt % | | | | | |
|---|---|---|---|---|---|---|
| NaOH wt % | 0.0 | 0.5 | 1.0 | 1.5 | 2.5 | 5.0 |
| | Percent Bleach Retention, No 2,4,6 SMS | | | | | |
| 0 | 0 | 0 | 0 | 0 | 11 | 24 |
| 0.2 | 67 | 76 | 77 | 70 | 77 | 67 |
| 0.5 | 85 | 82 | 89 | 88 | 87 | 85 |
| 0.75 | 87 | 88 | 91 | 91 | 90 | 85 |

| | $Na_2CO_3$ wt % | | | | | |
|---|---|---|---|---|---|---|
| NaOH wt % | 0.00 | 0.50 | 1.00 | 1.50 | 2.50 | 5.00 |
| | Percent Bleach Retention, with 1% 2,4,6 SMS | | | | | |
| 0 | 49 | 57 | 55 | 59 | 58 | 59 |
| 0.2 | 88 | 88 | 87 | 87 | 75 | 73 |
| 0.5 | 93 | 92 | 92 | 93 | 86 | 83 |
| 0.75 | 93 | 91 | 93 | 92 | 87 | 84 |

The results in Table 10 show that, without added sodium hydroxide or 2,4,6 SMS, the bleach retention is relatively poor (bleach retention 24%) even at a sodium carbonate level of 5%. In the presence of 1% 2,4,6 SMS by weight, but without added sodium hydroxide, the bleach retention is significantly boosted even without added carbonate (bleach retention 49% compared to 0%). These results illustrate the very important benefit provided by the addition of 2,4,6 SMS to such formulations.

The results in Table 10 also show that 2,4,6 SMS boosts the bleach retention significantly when 0.2% sodium hydroxide is present, yielding better bleach retention than is achievable with the addition of only 0.2% sodium hydroxide and no 2,4,6 SMS, especially at sodium carbonate levels below 2.5%.

Even at sodium hydroxide levels of 0.5% and 0.75%, across the different carbonate concentrations, the bleach retention of the formulations comprising 2,4,6 SMS is at least as good if not superior to the systems without added SMS at carbonate levels up to about 2.5%.

The results in Table 10 show that the addition of 2,4,6 SMS to the formulations boosts bleach retention significantly even in the presence of added sodium hydroxide and sodium carbonate, that is, the benefit of adding 2,4,6 SMS is not strongly dependent on the details of the electrolytes, buffers and hence the pH of formulations comprising an anionic surfactant and sodium hypochlorite.

Furthermore, the results show that bleach retention (i.e., stability) can be boosted while including little or no added strong bases such as sodium hydroxide (e.g., where the formulation includes no more than about 0.2%, 0.5%, or 0.75% by weight of soluble hydroxide salts). Because little or no sodium hydroxide is required to boost stability, the pH of the resulting formulation can be substantially more mild, if desired. For example, pH may be less than about 12, less than about 11, less than about 10, or from about 10-12.

Example 11

Bleach Retention Boosting from Addition of 2,4,6 SMS to Formulations Comprising an Amphoteric Surfactant, Hypochlorite, Sodium Carbonate, and Sodium Hydroxide The experiments in this example were conducted in a similar manner as described above in Example 10, but with an amphoteric surfactant (AMMONYX® LO, a dimethyl alkyl amine oxide, available from Stepan Co.). The initial bleach concentration was 1% sodium hypochlorite. Bleach retention results after 28 days at 49° C. are presented in Table 11.

TABLE 11

| | $Na_2CO_3$ wt % | | | | | |
|---|---|---|---|---|---|---|
| NaOH wt % | 0.00 | 0.50 | 1.00 | 1.50 | 2.50 | 5.00 |
| | Percent Bleach Retention, No 2,4,6 SMS | | | | | |
| 0 | 0 | 0 | 0 | 0 | 0 | 0 |
| 0.2 | 0 | 0 | 0 | 0 | 0 | 0 |
| 0.5 | 71 | 70 | 69 | 64 | 60 | 55 |
| 0.75 | 83 | 82 | 81 | 76 | 80 | 70 |
| | Percent Bleach Retention, 1% 2,4,6 SMS | | | | | |
| 0 | 36 | 46 | 52 | 50 | 55 | 48 |
| 0.2 | 76 | 77 | 74 | 76 | 63 | 68 |
| 0.5 | 88 | 85 | 86 | 83 | 83 | 77 |
| 0.75 | 88 | 90 | 84 | 82 | 83 | 79 |

The data in Table 11 show that the addition of 2,4,6 SMS to the formulations provides a very significant boost to the bleach retention at all tested concentrations of sodium hydroxide, both in the presence and absence of any sodium carbonate. Advantageously, the bleach retention of formulations comprising 1% 2,4,6 SMS (which is not necessarily the optimum level of addition) and 0.2% sodium hydroxide exceeds the bleach retention of the systems (at all carbonate levels) that can be achieved through the addition of 0.5% sodium hydroxide in the absence of 2,4,6 SMS. In other words, 2,4,6 SMS is a far better (i.e., effective while being milder) bleach retention booster than sodium hydroxide when the formulation comprises an amphoteric amine oxide surfactant.

Example 12

Bleach Retention Boosting from Addition of 2,4,6 SMS to Formulations Comprising a Cationic Surfactant, Hypochlorite, Sodium Carbonate, and Sodium Hydroxide The experiments in this example were conducted in a similar manner as described in Example 10, but with a cationic surfactant (AMMONYX® CETAC, cetyl (C16) trimethylammonium chloride, Stepan Co.). The initial bleach concentration was 1% sodium hypochlorite. Bleach retention results after 28 days at 49° C. are presented in Table 12.

TABLE 12

| | $Na_2CO_3$ wt % | | | | | |
|---|---|---|---|---|---|---|
| NaOH wt % | 0.00 | 0.50 | 1.00 | 1.50 | 2.50 | 5.00 |
| | Percent Bleach Retention, No 2,4,6 SMS | | | | | |
| 0 | 0 | 0 | 0 | 0 | 0 | 0 |
| 0.2 | 0 | 0 | 0 | 0 | 0 | 0 |
| 0.5 | 0 | 0 | 0 | 0 | 0 | 0 |
| 0.75 | 0 | 2 | 0 | 0 | 0 | 0 |
| | Percent Bleach Retention, 1% 2,4,6 SMS | | | | | |
| 0 | 19 | 32 | 49 | 48 | 56 | 43 |
| 0.2 | 77 | 71 | 73 | 74 | 71 | 59 |
| 0.5 | 78 | 88 | 89 | 79 | 83 | 70 |
| 0.75 | 86 | 79 | 85 | 88 | 87 | 75 |

The data in Table 12 indicate that this cationic surfactant has rather poor bleach retention when aged for 28 days at 49° C., and addition of sodium hydroxide and sodium carbonate separately or together do not yield any significant bleach retention boost after 28 days aging.

The data in Table 12 also show that the addition of 1% 2,4,6 SMS to the formulations provides a very significant boost to bleach retention, even in the absence of any added sodium hydroxide. In fact, at 0% added sodium hydroxide and 2.5% sodium carbonate, bleach retention of about 50% or more can be achieved with the addition of 1% 2,4,6 SMS (which is not necessarily the optimum level). The addition of 0.2% sodium hydroxide and 1 weight % 2,4,6 SMS can further improve the bleach retention values over a range of carbonate levels, thus allowing flexibility in the formulations to optimize other aspects of the formulation such as cost or pH as needed.

Thus the data in Examples 10, 11 and 12 show that boosting of bleach retention characteristics through the addition of 2,4,6 SMS can be achieved with formulations including hypochlorite with various levels of sodium hydroxide and/or a sodium carbonate buffer where those compositions may further comprise anionic, cationic and/or amphoteric surfactants. Applicants speculate, without being bound by theory, that the chaotropic interactions of 2,4,6 SMS with surfactant micelles are not unique to the type of surfactant or electrolyte or buffer components of the formulations. The extent of the boost in bleach retention achieved through the addition of the 2,4,6 SMS, which can be superior to that achieved via the addition of caustic or buffers, may depend on the nature of the surfactant in a particular formulation. Surfactants which show greater reactivity with hypochlorite and poorer bleach retention under typical conditions (i.e., absent 2,4,6 SMS) may tend to benefit more from the addition of 2,4,6 SMS.

Examples 13-30

Examples 13-30, in the tables below, describe further examples of various hypochlorite formulations that may be stabilized with 2,4,6 SMS.

TABLE 13

| Ingredient, wt % | Example 13 Fragranced Laundry Bleach | Example 14 Outdoor Bleach Cleaner | Example 15 Laundry Bleach with Detergent | Example 16 Laundry Bleach with Detergent |
|---|---|---|---|---|
| NaOCl | 4.2 | 8.3 | 2.0 | 2.0 |
| $Na_2CO_3$ | | 1 | 1.0 | 1.0 |
| NaOH | 0.35 | 0.2 | 0.2 | 0.2 |
| 2,4,6 SMS | 0.04 | 3.0 | 1.0 | 1.0 |
| Fragrance oil | 0.07 | | 0.02 | 0.02 |
| SLS | | 1.0 | | |
| Secondary alkane sulfonate | | | 1.25 | 1.5 |
| C14 amine oxide (AMMONYX ® MO) | | | 1.25 | 1.0 |
| Sodium polyacrylate | 0.075 | | | |
| Cocobetaine surfactant | 0.00015 | | | |
| Water | Balance | Balance | Balance | Balance |

TABLE 14

| Ingredient, wt % | Example 17 Laundry Bleach with Detergent | Example 18 Thick Spray Cleaner | Example 19 Liquid dish-wash with bleach | Example 20 Automatic dishwash gel |
|---|---|---|---|---|
| NaOCl | 2.0 | 1.0 | 2.0 | 6.0 |
| $Na_2CO_3$ | 1.0 | 1.0 | 2.0 | 1.5 |
| NaOH | 0.2 | 0.335 | 0.4 | 0.2 |
| 2,4,6 SMS | 1.5 | 0.2 | 3.0 | 5.0 |
| Fragrance oil | 0.02 | 0.05 | 0.02 | 0.01 |
| Secondary alkane sulfonate | | | 10.0 | 28.0 |
| C14 amine oxide (AMMONYX ® MO) | | 0.51 | | 7.0 |
| C12 amine oxide (AMMONYX ® LO) | | 0.39 | 10.0 | |
| Alkyl ethoxy-sulfate (Steol ® CS-230) | 2.0 | | | |
| Alkylbenzene Sulfonate Surfactant (BIO-SOFT ® S-101) | 1.0 | | | |
| Disperse Green dye 87-3007 | | 0.00075 | | |
| Coconut fatty acid | | 0.76 | | |
| Potassium iodide | | 0.0055 | | |
| Acrylate polymer Alcosperse ® 7100 | | 0.2 | | |
| Water | Balance | Balance | Balance | Balance |

TABLE 15

| Ingredient, wt % | Example 21 Dilutable Floor Cleaner with bleach | Example 22 Lotion for Pre-moistened wipes with bleach | Example 23 Lotion for Pre-moistened wipes with bleach | Example 24 Lotion for Pre-moistened wipes with bleach |
|---|---|---|---|---|
| NaOCl | 0.5 | 0.65 | 0.65 | 0.65 |
| $Na_2CO_3$ | 1.0 | 0.5 | | |
| NaOH | | | 0.2 | 0.2 |
| 2,4,6 SMS | 4.0 | 0.5 | 0.5 | 0.5 |
| Fragrance oil | 1.0 | 0.03 | 0.03 | 0.03 |
| SLS | | 0.1 | 0.1 | |
| Secondary alkane sulfonate | 5.0 | | | |
| C14 amine oxide (AMMONYX ® MO) | | 0.1 | 0.1 | |
| C12 amine oxide (AMMONYX ® LO) | 5.0 | | | 0.2 |
| Cetyl trimethyl ammonium chloride | | 0.01 | | |
| Sodium metasilicate | | | 0.5 | |
| Calcium EDTA | | | | 0.01 |
| Water | Balance | Balance | Balance | Balance |

TABLE 16

| Ingredient, wt % | Example 25 Lotion for Pre-moistened wipes with bleach | Example 26 Drain Opener with Bleach | Example 27 Thick Drain Opener with Bleach |
|---|---|---|---|
| NaOCl | 2.1 | 7.0 | 5.8 |
| NaOH | 0.2 | 2.1 | 1.85 |
| 2,4,6 SMS | 1.0 | 1.0 | 0.52 |
| Fragrance oil | 0.08 | | |
| C14 amine oxide (AMMONYX ® MO) | 0.5 | 1.13 | |
| C12 amine oxide (AMMONYX ® LO) | | 1.13 | |
| Sodium metasilicate | 0.13 | 0.2 | 0.12 |
| Coconut fatty acid | | 0.75 | |
| Cetyl betaine | | | 0.74 |
| Water | Balance | Balance | Balance |

TABLE 17

| Ingredient, wt % | Example 28 Laundry Gel with Bleach | Example 29 Laundry Gel with Bleach | Example 30 Laundry Gel with Bleach |
|---|---|---|---|
| NaOCl | 2.0 | 2.0 | 2.0 |
| $Na_2CO_3$ | 2.0 | 1.5 | 1.0 |
| NaOH | 0.2 | 0.12 | 0 |
| 2,4,6 SMS | 10 | 15.0 | 20.0 |
| Fragrance oil | 1.0 | 1.0 | 1.0 |
| SLS | 12 | 20.0 | 20.0 |
| Alkyl ethoxysulfate (Steol ® CS-230) | 25 | | |
| Alkyl ethoxylate (BIO-SOFT ® N91-6) | 12 | 26.0 | 26.0 |
| Disperse Green dye 87-3007 | 0.001 | 0.00075 | 0.00075 |
| Coconut fatty acid | 1.0 | 0.5 | 0.5 |
| Potassium iodide | 0.2 | 0.1 | 0.1 |
| Water | Balance | Balance | Balance |

Lotions for pre-moistened wipes (e.g., as in Examples 22-25) may be added to nonwoven substrates to produce pre-moistened wipes or other substrate cleaning devices. The ratio of lotion to substrate may be from about 0.1:1 and 10:1 by weight. Such wipes or other substrates may be employed as disinfecting wipes, or for floor cleaning in combination with various tools configured to attach to the wipe or substrate. Additional details of exemplary substrates, including non-woven substrates are found in U.S. Publication No. 2005/0155630, herein incorporated by reference in its entirety.

Without departing from the spirit and scope of the invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A method for treating a surface, the method comprising:
providing a liquid composition comprising:
a hypohalite or hypohalous acid; and
a soluble salt of 2,4,6 mesitylene sulfonate; and
25% to 98% water; and
contacting said composition with a surface, wherein said composition treats the surface.

2. The method of claim 1, wherein the soluble salt of 2,4,6 mesitylene sulfonate is an alkali metal salt of 2,4,6 mesitylene sulfonate.

3. The method of claim 1, wherein the soluble salt of 2,4,6 mesitylene sulfonate is sodium 2,4,6 mesitylene sulfonate.

4. The method of claim 1, wherein the composition comprises a buffer.

5. The method of claim 4, wherein the composition comprises a surfactant.

6. The method of claim 5, wherein the composition an anionic surfactant.

7. The method of claim 6, wherein the composition comprises a carbonate buffer.

8. The method of claim 1, wherein the composition does not comprise sodium xylene sulfonate, sodium para-toluene sulfonate (Na-PTSA), naphthalene sulfonate, benzene sulfonate, and chloro benzene sulfonate.

9. The method of claim 1, wherein the composition may be substantially free of sodium 2,4,5 mesitylene sulfonate, 2,3,5 mesitylene sulfonate or combinations thereof.

10. A method for cleaning a surface, the method comprising:
providing a liquid composition comprising:
a hypohalite or hypohalous acid;
a soluble salt of 2,4,6 mesitylene sulfonate;
a buffer; and
25% to 98% water; and
contacting said composition with a surface, wherein said composition cleans the surface.

11. The method of claim 10, wherein the buffer is selected from the group consisting of carbonates, bicarbonates, borates, phosphates, silicates, borates, and combinations thereof.

12. The method of claim 10, wherein the buffer is a carbonate.

13. The method of claim 10, wherein the composition comprises from about 0.01% to about 10% by weight of the buffer.

14. The method of claim 10, wherein the composition does not comprise sodium xylene sulfonate, sodium para-toluene sulfonate (Na-PTSA), naphthalene sulfonate, benzene sulfonate, and chloro benzene sulfonate.

15. The method of claim 10, wherein the composition may be substantially free of sodium 2,4,5 mesitylene sulfonate, 2,3,5 mesitylene sulfonate or combinations thereof.

16. A method for bleaching a surface, the method comprising:
providing a liquid composition comprising:
a hypohalite or hypohalous acid;
a soluble salt of 2,4,6 mesitylene sulfonate;
a surfactant; and
25% to 98% water; and
contacting said composition with a surface, wherein said composition bleaches the surface.

17. The method of claim 16, wherein the surfactant is selected from the group consisting of anionic surfactants, cationic surfactants, nonionic surfactants, amphoteric surfactants, zwitterionic surfactants, and combinations thereof.

18. The method of claim 16, wherein the surfactant is an anionic surfactant.

19. The method of claim 16, wherein the composition does not comprise sodium xylene sulfonate, sodium para-toluene sulfonate (Na-PTSA), naphthalene sulfonate, benzene sulfonate, and chloro benzene sulfonate.

20. The method of claim 16, wherein the composition may be substantially free of sodium 2,4,5 mesitylene sulfonate, 2,3,5 mesitylene sulfonate or combinations thereof.

* * * * *